US009085973B2

(12) United States Patent
Diehl et al.

(10) Patent No.: US 9,085,973 B2
(45) Date of Patent: Jul. 21, 2015

(54) METHOD AND DEVICE FOR THE "IN-SITU" TRANSPORT OF BITUMEN OR EXTRA-HEAVY OIL

(75) Inventors: Dirk Diehl, Erlangen (DE); Bernd Wacker, Herzogenaurach (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 309 days.

(21) Appl. No.: 13/580,762

(22) PCT Filed: Feb. 9, 2011

(86) PCT No.: PCT/EP2011/051861

§ 371 (c)(1), (2), (4) Date: Nov. 2, 2012

(87) PCT Pub. No.: WO2011/107331

PCT Pub. Date: Sep. 9, 2011

(65) Prior Publication Data

US 2013/0062064 A1 Mar. 14, 2013

(30) Foreign Application Priority Data

Mar. 3, 2010 (DE) ..... 10 2010 010 219
May 11, 2010 (DE) ..... 10 2010 020 154

(51) Int. Cl.

| | |
|---|---|
| ***E21B 43/24*** | (2006.01) |
| ***E21B 36/00*** | (2006.01) |
| ***E21B 36/04*** | (2006.01) |
| ***E21B 43/30*** | (2006.01) |

(52) U.S. Cl.

CPC ..... *E21B 43/2401* (2013.01); *E21B 36/001* (2013.01); *E21B 36/04* (2013.01); *E21B 43/305* (2013.01)

(58) Field of Classification Search

USPC ..... 166/248, 272.1, 272.7, 60

See application file for complete search history.

(56) References Cited

U.S. PATENT DOCUMENTS

| | | | | |
|---|---|---|---|---|
| 3,388,324 | A * | 6/1968 | Sloughter | 324/373 |
| 4,135,579 | A | 1/1979 | Debettencourt | |
| 5,065,819 | A | 11/1991 | Kasevich | |
| 8,371,371 | B2 * | 2/2013 | Diehl et al. | 166/60 |
| 2007/0102152 | A1 | 5/2007 | Forgeron | |
| 2011/0042063 | A1 * | 2/2011 | Diehl et al. | 166/60 |
| 2011/0146968 | A1 * | 6/2011 | Diehl | 166/60 |

FOREIGN PATENT DOCUMENTS

| | | | |
|---|---|---|---|
| DE | 102008044953 | A1 | 3/2010 |
| DE | 102008044955 | A1 | 3/2010 |
| WO | WO 2009135806 | A1 | 11/2009 |

* cited by examiner

*Primary Examiner* — William P Neuder

(57) ABSTRACT

A technique is provided for extracting a substance containing hydrocarbon from a reservoir, wherein the reservoir is applied with thermal energy in order to reduce the viscosity of the substance. As per the technique, at least two conductor loops for the inductive energization are provided as electric/electromagnetic heating elements. Each of the at least two conductor loops has at least two extended conductors, which are guided horizontally inside the reservoir. At least two alternating current generators are provided for electric power, each being connected to a respective conductor loop. The technique involves operating a first of the at least two alternating current generators and at least a second of the at least two alternating current generators synchronously with respect to their frequency and with a fixed phase position in relation to one another.

20 Claims, 2 Drawing Sheets

METHOD AND DEVICE FOR THE "IN-SITU" TRANSPORT OF BITUMEN OR EXTRA-HEAVY OIL

CROSS REFERENCE TO RELATED APPLICATIONS

This application is the US National Stage of International Application No. PCT/EP2011/051861, filed Feb. 9, 2011 and claims the benefit thereof. The International Application claims the benefits of German application No. 10 2010 010 219.9 DE filed Mar. 3, 2010 and German application No. 10 2010 020 154.5 DE filed May 11, 2010. All of the applications are incorporated by reference herein in their entirety.

FIELD OF INVENTION

The invention relates to a method for the "in-situ" extraction of bitumen or extra-heavy oil from oil sands deposits as a reservoir. In addition, the invention also relates to the associated apparatus for implementing the method.

BACKGROUND OF INVENTION

To extract extra-heavy oil or bitumen from oil sands or oil shale deposits by means of pipeline systems, which are introduced through boreholes, the flowability of the source material present in a solid consistency must be significantly increased. This can be achieved by increasing the temperature of the deposit in the reservoir.

If to this end, an inductive heating element is used exclusively or to assist with the conventional SAGD (Steam Assisted Gravity Drainage) method, the problem occurs whereby adjacent simultaneously energized inductors can mutually negatively influence one another. Adjacent oppositely energized inductors weaken in respect of the heating output deposited in the reservoir.

In the former German patent applications with application numbers 10 2007 008 292.6, 10 2007 036 832.3 and 10 2007 040 605.5, individual inductor pairs, i.e. forward and return conductors, are energized in predetermined geometric configurations in order to inductively heat the reservoir. In this process the current rating is used to set the desired heating output, while the phase position is fixedly set at 180° between adjacent inductors. This out-of-phase energization inevitably results from the operation of an inductor pair with forward and return conductors to a generator. In a parallel patent application by the applicant with the title "Installation for the "in-situ" extraction of a substance containing hydrocarbon", the control of the heating output distribution in an array of inductors is inter alia described, wherein this is achieved by the ability to set the current amplitudes and the phase position of adjacent inductor pairs. All previous patent applications assume that energization throughout longer periods of days to months only experiences small adjustments and a fixed assignment of a generator to an inductor pair exists.

SUMMARY OF INVENTION

On this basis the object of the invention is to propose suitable methods and create associated apparatuses which are used to improve the efficiency when extracting from oil sands or oil shale reservoirs.

The object is achieved by the features of the independent claims. Developments of the method and the associated apparatus form the subject matter of the respective dependent claims.

The invention relates to a method for extracting a substance containing hydrocarbon, in particular bitumen or extra-heavy oil, from a reservoir, wherein the reservoir is applied with thermal energy to reduce the viscosity of the substance, to which end at least two conductor loops for inductive energization are provided as electric/electromagnetic heating elements. Each of the at least two conductor loops comprises at least two linearly extended conductors, which are guided horizontally into a predetermined depth inside the reservoir. At least two alternating current generators for electric power are provided, each being connected to a respective conductor loop, wherein a first of the at least two alternating current generators and at least a second of the at least two alternating current generators are operated synchronously with respect to their frequency and with a fixed phase position in relation to one another.

The conductors in this way are preferably essentially linear and parallel to one another in a section.

The phase position preferably has a phase difference of zero. Alternatively, provision can be made for a constant phase difference which differs from zero. It is only essential that the two generators have a fixed, i.e. continuous phase position in relation to one another.

The synchronicity of the fed-in current also results in the conductor loops in the reservoir synchronously developing a magnetic field in relation to one another and the induced electrical field in the reservoir thus intensifying.

In the prior art, provision can be made for the operation of several conductor loops at one location, by each inverter being connected sequentially. This means that the average energy quantity in this intermittent service cannot be maximized. The intermittent service and alternating operation of inductor loops can be provided here because on account of interference of the applied average frequency, eddy currents which cause dissipation of Joule's heat in the reservoir, can be canceled out.

When extracting hydrocarbons such as extra-heavy oils or bitumen from oil sands or oil shale deposits by means of pipeline systems, which are introduced through boreholes, the present invention is nevertheless aimed in particular at significantly increasing the flowability thereof. Gravity can then achieve drainage of the hydrocarbon mixture.

It is proposed in accordance with the invention to synchronously operate the alternating current generators (inverters) of all conductor loops, in particular with the same frequency and a constant, but preferably adjustable, phase position in relation to one another. In the event that parts of the reservoir are to be heated differently, an individual current amplitude regulation of the individual conductor loops and alternatively or in addition an adjustment of the phase position can take place.

Synchronous operation with the same frequency and phase position provides for an increased maximum possible energy, which the inverter can supply together, being introduced into the reservoir.

With a change in the frequency and/or phase position of the first of the at least two alternating current generators, the frequency and/or phase position of the second of the at least two alternating current generators can preferably be adjusted such that after this adjustment, the two alternating current generators are again operated synchronously in relation to one another in respect of the frequency and/or phase position.

In one embodiment, provision can be made for instance for the energization of the conductor loops to be changed in different temporal extraction phases of the reservoir in respect of current and/or voltage amplitude and/or frequency and/or phase position. In respect of the frequency, the variation to +/−10% can be restricted by the resonance frequency of the capacitively compensated conductor loops.

In particular the first of the at least two alternating current generators and the second of the at least two alternating current generators can nevertheless be operated such that their phase positions are constant in relation to one another, wherein their phase positions can be predeterminably offset in relation to one another.

The at least two alternating current generators can preferably generate the same or different current amplitudes by comparison with one another.

According to an advantageous embodiment of the invention, the at least two alternating current generators can be synchronized with one another such that information representing a change in the frequency and/or a change in the phase is transferred from a first of the at least two alternating current generators to another of the at least two alternating current generators.

Information can preferably be transferred here between control units of the alternating current generators.

One of the alternating current generators can therefore be defined as a master, which preferably routes the cited information, which may represent a clock signal or an item of frequency information, to all further alternating current generators (slaves) by way of a bus coupling, e.g. fiber optic cables, or by way of a radio signal, so that the same frequency, for instance a preferred working frequency between 1 kHz and 200 kHz, is used during operation for all alternating current generators. In addition, as mentioned previously, the current amplitude and the phase difference relative to the master generator can be set individually on each alternating current generator.

In an alternative embodiment, the at least two alternating current generators can be synchronized with one another such that information representing a change in the frequency and/or a change in the phase is transferred from a clock generator to the at least two alternating current generators.

A signal of a separately arranged reference oscillator can therefore be distributed for instance to all alternating current generator control units and the desired frequency and the desired phase position, possibly including an individually offset phase position, are generated there by means of a synthesizer (with e.g. PLL connections).

Information is preferably transferred digitally for synchronization between control units of the alternating current generators.

Furthermore, the frequency and/or phase position for each of the at least two alternating current generators can be updated by means of each of the at least two alternating current generators on account of receiving information representing a change in the frequency and/or change in the phase. In this way the updating of the frequency and/or phase of all alternating current generators preferably takes place simultaneously. Alternatively or in addition, the current and/or voltage amplitude of all generators can briefly, for instance for a few seconds to minutes, be reduced to a small value, for instance below 5% of a maximum value, or to zero, while the frequency and/or phase differences are updated. The increase of the starting currents of all generators to the target values then takes place with updated parameters.

Furthermore, a predetermined value for a current amplitude and a predetermined value for a phase difference compared to the transferred phase position can be maintained for the respective alternating current generator when updating the frequency and/or phase position.

Furthermore, the subject matter of an inventive embodiment may be that with the electrical heating of the reservoir, the parameters of the necessary electrical alternating current generators relevant thereto can be embodied to be temporally and locally variable and provision can be made for these parameters to change from outside of the reservoir in order to optimize the extraction volume during the extraction of bitumen or extra-heavy oil. The most comprehensive of control possibilities are therefore created for the energization of inductors in the conductor loops, wherein locally acquired temperatures can also be used in particular as control variables. To this end, the temperatures inside the reservoir, but if applicable also outside of the reservoir, can be used.

According to an embodiment of the invention, inductors with minimal thermal loads can preferably be energized and/or reservoir areas with low temperatures can preferably be heated.

Furthermore, it is possible to switch between two energization types, temporally sequential or simultaneous energization with several generators, during different temporal extraction phases of the reservoir.

A spatially closely adjacent line guidance can be achieved by an overburden on the generator and/or connection side, in order to avoid and/or reduce unwanted heating of the overburden.

Furthermore, the alternating current generators can be configured such that their operating frequencies can be adjusted.

Furthermore, adjacent conductor loops can also be energized such that no cancellation effects occur.

Use can additionally be made of the fact that the active resistance, which shows the reservoir as a secondary winding, for forward and return conductors which are at a great distance from one another, can be much higher than is the case with closely adjacent conductors, as a result of which high heating outputs can be introduced into the reservoir with comparatively low currents in the conductor loops (primary winding).

BRIEF DESCRIPTION OF THE DRAWINGS

Further details and advantages of the invention result from the subsequent description of the figures of exemplary embodiments with the aid of the drawing in conjunction with the claims, in which:

DETAILED DESCRIPTION OF INVENTION

Figure 1:
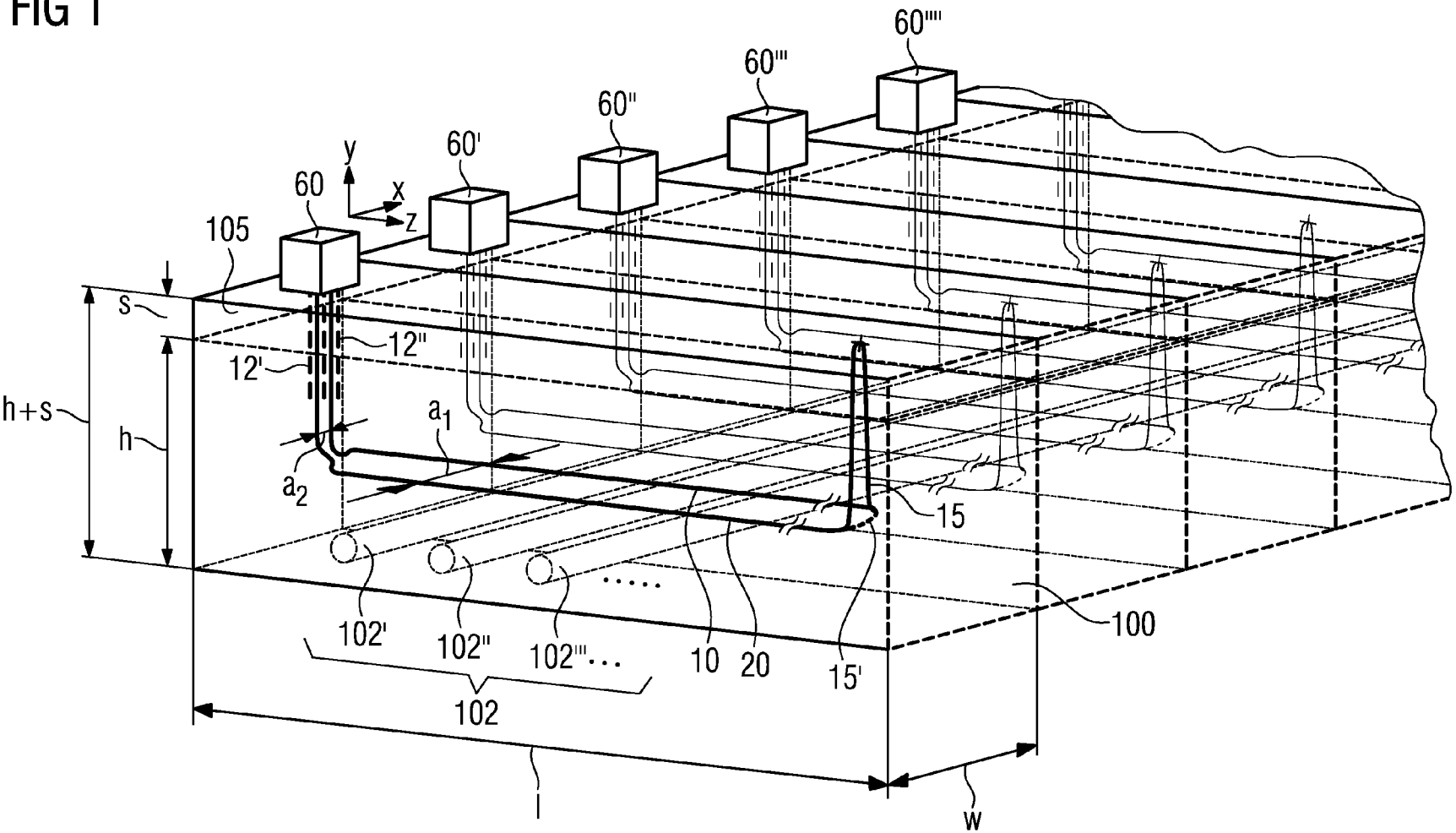
FIG. 1 shows a cut-out from an oil sands deposit with repetitive units as a reservoir and each electrical conductor structure running horizontally in the reservoir.
Figure 2:
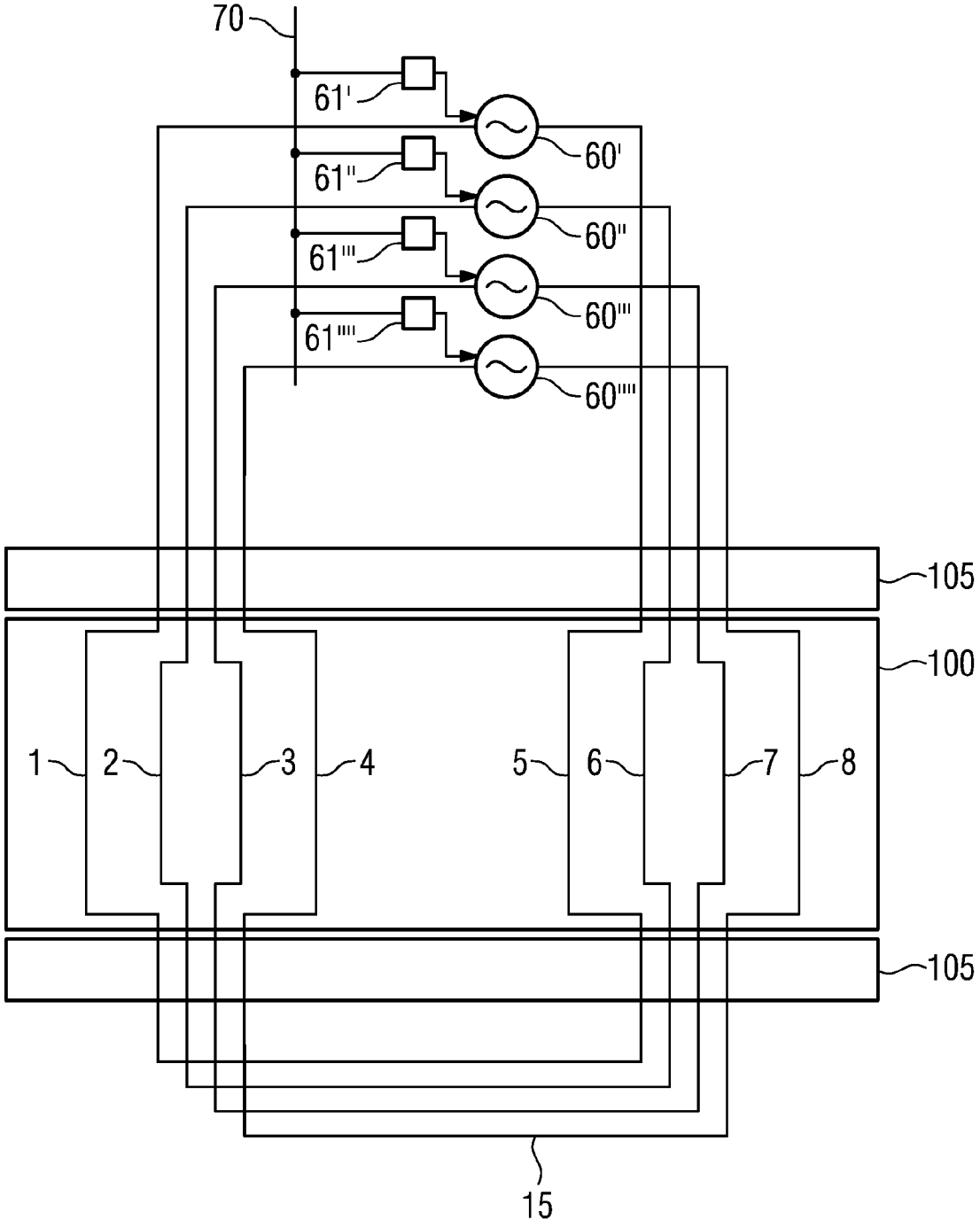
FIG. 2 shows the layout of the circuitry of four inductor pairs with simultaneous energization having separate generators with a frequency which can be adjusted in relation to one another in each instance, wherein the associated forward and return conductor are disposed spatially far from one another.

While FIG. 1 shows a perspective representation as a linearly repetitive arrangement (array), a view, i.e. a horizontal section in the inductor plane seen from above, is shown in FIG. 2, wherein the overburden is found on both sides. The same elements have the same reference characters in the Figures. The figures are then described together in part.

To extract extra-heavy oils or bitumen from oil sands or oil shale deposits by means of pipeline systems which are introduced into the oil deposits through boreholes, the flowability of the solid matter-type bitumen and/or the viscous extra-heavy oil must be significantly improved. This can be achieved by increasing the temperature of the reservoir, which in turn reduces the viscosity of the bitumen and/or extra-heavy oil.

The earlier patent applications by the applicant predominantly focused on using an inductive heating element to assist with the conventional SAGD method. In this process forward and return conductors of the inductor pipes, which together form the inductor loop, are arranged at a comparatively large distance of 50 to 150 m for instance.

So-called EMGD methods are increasingly considered, in which the inductive heating element is to be used as the sole heating method of the reservoir without introducing hot vapor, which inter alia brings about the advantage of reduced and/or practically no water consumption.

With a single inductive heating element, the inductors have to be arranged closer to the bitumen production pipe in order to enable a prompt start to production while simultaneously reducing pressure in the reservoir. The forward and return conductors likewise approach one another. This is problematical in that the mutual field weakening of the oppositely energized forward and return conductors is considerable and results in reduced heating output with a constant current rating, i.e. in lower active resistances. This may however be compensated for in principle by higher inductor currents, as a result of which the demands on the ampacity of the conductor and thus its manufacturing costs would however significantly increase.

It is possible to energize spatially closely adjacent conductors in a temporally sequential manner, in other words not simultaneously, as a result of which the problem of field weakening does not occur. It is advantageous here that a generator (inverter) can be used for several conductor loops. It is however disadvantageous for the inductors to only be energized for a fraction of the time and to only then contribute to heating the reservoir.

FIG. 1 shows an arrangement for inductive heating. This can be formed by a long, i.e. some 100 m to 1.5 km, conductor loops 10 to 20 placed in a reservoir 100, wherein the forward conductor 10 and return conductor 20 are guided at the predetermined distance adjacent to one another, in other words at the same depth, and are connected to one another at the end by way of an element 15 as a conductor loop inside or outside of the reservoir 100. At first, the conductors 10 and 20 are guided vertically downwards or at a predetermined angle into boreholes through the overburden and are supplied with electrical power by a HF generator 60, which can be accommodated in an external housing.

Conductors 10 and 20 essentially run in particular at the same depth either adjacent to one another or one above the other. In this way an offset of the conductor may be expedient. Typical distances between the forward and return conductors 10, 20 are 10 to 60 m with an exterior diameter of the conductor of 10 to 50 cm (0.1 to 0.5 m).

An electrical double wire circuit 10, 20 in FIG. 1 with the afore-cited typical dimensions has a longitudinal inductance of 1.0 to 2.7 pH/m. The inductive drop in voltage along the double wire circuit, herewith meaning the forward and return conductor of the inductor, is compensated for by the series capacitances introduced. The transverse capacitance, which only lies at 10 to 100 pF/m with the cited dimensions, is not effective since practically no voltage exists between the conductors and can be disregarded. Wave effects are thus prevented.

The characteristic frequency of an inductor arrangement from FIG. 1 is determined by the loop length of the double wire circuit 10, 20 and the integrated series capacitances.

FIG. 2 shows four high frequency power generators 60' 60", 60''', 60'''' present as inventive alternating current generators, which each control two of the inductors 1 to 8 in pairs (four inductors 1, 2, 3, 4 as forward conductors, the remaining four inductors 5, 6, 7, 8 as return conductors).

The individual inductors 1 to 8 are arranged in the reservoir 100 in accordance with FIG. 1. Regions 105 exist on both sides of the reservoir 100, which are not to be heated and phenomenonologically represent the "overburden". Furthermore, a link 15 is connected to the ends of the inductors, which connects the forward and return conductors to one another. The link 15 can be arranged above or below ground.

It is possible with this arrangement in particular to simultaneously energize several inductor pairs with different current intensities at different frequencies, wherein in accordance with the invention provision is not made for operation with different frequencies, but instead for a synchronous operation of the generators and thus also the inductors.

The power generators 60', 60", 60''', 60'''' each comprise a control unit 61', 61", 61''', 61'''', which are connected to one another with a communicative or data link by way of a bus 70 or another link. Information can be exchanged between the control units 61', 61", 61''', 61'''' by way of the bus 70.

It is assumed that the power generator 60' represents a master in respect of the frequency and phase position to be adjusted, to which the other power generators 60", 60''', 60'''' adjust. The frequency and phase position currently set at the power generator 60' is preferably determined by the controller 61' of the power generator 60' and transferred to all further control units 61", 61''', 61'''' with any coding. The received control units 61", 61''', 61'''' evaluate the communication received by way of the bus 70 and thereupon control the dependent power generators 60", 60''', 60'''' such that these adjust the frequency and the phase position for the current to be output to the frequency and phase position of the master power generator 60'.

Essentially the same frequency as the frequency with the master power generator 60' is preferably set by all dependent power generators 60", 60''', 60''''.

In respect of the phase position, it may be meaningful for all dependent power generators 60", 60''', 60'''' to be adjusted to precisely the same phase position of the master power generator 60'. The phase difference is therefore zero. Alternatively, the power generators 60', 60", 60''', 60'''' can be operated with a phase position which is offset in relation to one another, provided no displacements occur during operation. A phase position which has a phase difference relative to the master power generator 60' which differs from zero is therefore set by the dependent power generators 60", 60''', 60'''', wherein the phase difference in the time response nevertheless remains constant and unchangeable.

Changes to the frequency and to the phase position are preferably only to be performed if these have to be readjusted in order furthermore to be synchronous.

Alternatively to the specified master-slave structure, all provided power generators 60', 60", 60''', 60'''' can be operated as a function of a clock signal. This clock signal can be transferred to all control units 61', 61", 61''', 61'''' of the power generators 60', 60", 60''', 60'''' which are connected to the bus 70, in order thereupon to adjust and/or update all power generators 60', 60", 60''', 60'''' in accordance with the clock signal in terms of frequency and phase position.

Irrespective of the frequency and phase position, it may be advantageous for all power generators 60', 60", 60''', 60'''' to be operated with different current amplitudes, according to the conditions, e.g. temperature, in the reservoir.

The coupling via a bus 70 is only visible by way of example. Different communication paths are conceivable.

In order to achieve good correspondence and stable operation, an oscillator can also be operated, which prespecifies the frequency.

Reference should then be made to an underground installation of the generator also being possible in an arrangement of the power generator outside of the generator, which in some instances may be advantageous. The electrical output would then be guided downwards at a low frequency, i.e. 50-60 Hz or if necessary also as direct current, and a conversion in the kHz range underground may take place so that no losses in the overburden occur.

The invention claimed is:

1. A method for extracting a substance containing hydrocarbon from a reservoir, wherein the reservoir is applied with thermal energy in order to reduce the viscosity of the substance, the method comprising:

providing at least two conductor loops for inductive energization as electric/electromagnetic heating elements, wherein each of the at least two conductor loops comprises at least two extended conductors, which are guided horizontally inside the reservoir, providing at least two alternating current generators for electric power, each being connected to a respective conductor loop, and operating a first of the at least two alternating current generators and at least a second of the at least two alternating current generators synchronously with respect to their frequency and with a fixed phase position in relation to one another.

2. The method as claimed in claim 1, further comprising:

adjusting the frequency and/or phase position of the at least a second of the at least two alternating current generators with a change in the frequency and/or phase position of the first of the at least two alternating current generators, such that after this adjustment, the at least two alternating current generators are operated again synchronously with respect to frequency and with a fixed phase position in relation to one another.

3. The method as claimed in claim 1, further comprising:

changing an energization of the conductor loops in relation to a current and voltage amplitude and/or frequency and/or phase position, in different temporal extraction phases of the reservoir.

4. The method as claimed in claim 1, further comprising:

operating the first of the at least two alternating current generators and the second of the at least two alternating current generators such that their phase positions are constant in relation to one another.

5. The method as claimed in claim 1, wherein the phase positions of the first and the second alternating current generators are predeterminably offset in relation to one another.

6. The method as claimed in claim 1, wherein the at least two alternating current generators have the same current amplitudes.

7. The method as claimed in claim 1, wherein the at least two alternating current generators have the same or different amplitudes.

8. The method as claimed in claim 1, further comprising:

synchronizing the at least two alternating current generators with one another such that information representing a change in the frequency and/or a change in the phase is transferred from a first of the at least two alternating current generators to another of the at least two alternating current generators.

9. The method as claimed in claim 1, further comprising:

synchronizing the at least two alternating current generators with one another such that information representing a change in the frequency and/or a change in the phase is transferred from a clock generator to the at least two alternating current generators.

10. The method as claimed in claim 8, wherein the frequency and/or the phase position for each of the at least two alternating current generators is updated by each of the at least two alternating current generators on account of receipt of information representing a change in the frequency and/or phase.

11. The method as claimed in claim 9, wherein the frequency and/or the phase position for each of the at least two alternating current generators is updated by each of the at least two alternating current generators on account of receipt of information representing a change in the frequency and/or phase.

12. The method as claimed in claim 10, wherein a predetermined value for a current amplitude and a predetermined value for a phase difference compared with a transferred phase position is retained for the respective alternating current generator when the frequency and/or phase position is updated.

13. The method as claimed in claim 11, wherein a predetermined value for a current amplitude and a predetermined value for a phase difference compared with a transferred phase position is retained for the respective alternating current generator when the frequency and/or phase position is updated.

14. The method as claimed in claim 1, further comprising locally acquiring temperatures within the reservoir for controlling energization of the conductor loops.

15. The method as claimed in claim 14, wherein controlling the energization of the conductor loops comprises controlling phase positions of the energization and/or controlling the current amplitude of the alternating current generators.

16. An apparatus for extracting a substance containing hydrocarbon from a reservoir, wherein the reservoir can be applied with thermal energy in order to reduce the viscosity of the substance, the apparatus comprising:

at least two conductor loops for inductive energization, which are provided as electric/electromagnetic heating units, wherein each of the at least two conductor loops comprises at least two extended conductors, which are guided horizontally inside the reservoir, at least two alternating current generators for electric power, each being connected to a respective conductor loop, and a device for coupling a first of the at least two alternating current generators to at least a second of the at least two alternating current generators, said device being configured to synchronously operate the at least two alternating current generators with respect to their frequency and with a fixed phase position in relation to one another.

17. The apparatus as claimed in claim 16, wherein the at least one alternating current generator for the electric power is variable in respect of parameters of said at least one alternating current generator determining a starting output.

18. The apparatus as claimed in claim 16, wherein temperature sensors are arranged inside or outside the reservoir and are used to temporally control the alternating current generators.

19. The apparatus as claimed in claim 18, wherein said temporally controlling of the alternating current generators includes control of phase positions of currents generated by the alternating current generators and/or control of current amplitude of the alternating current generators.

20. The apparatus as claimed in claim 16, wherein temperature sensors are arranged in and/or on the conductor loops in the reservoir and are used to temporally control and/or to control a respective current amplitude of the alternating current generators in order to prevent overheating of the conductor loops.

* * * * *